US007990075B2

(12) United States Patent
Matsuzaki et al.

(10) Patent No.: US 7,990,075 B2
(45) Date of Patent: Aug. 2, 2011

(54) HIGH INTENSITY DISCHARGE LAMP LIGHTING DEVICE AND LIGHTING FIXTURE

(75) Inventors: Nobutoshi Matsuzaki, Neyagawa (JP); Kenichi Fukuda, Burlington, MA (US)

(73) Assignee: Panasonic Electric Works Co., Ltd., Osaka (JP)

( * ) Notice: Subject to any disclaimer, the term of this patent is extended or adjusted under 35 U.S.C. 154(b) by 402 days.

(21) Appl. No.: 12/438,583

(22) PCT Filed: May 23, 2007

(86) PCT No.: PCT/JP2007/060537

§ 371 (c)(1),
(2), (4) Date: Feb. 24, 2009

(87) PCT Pub. No.: WO2008/023483

PCT Pub. Date: Feb. 28, 2008

(65) Prior Publication Data

US 2009/0289581 A1 Nov. 26, 2009

(30) Foreign Application Priority Data

Aug. 25, 2006 (JP) ..... 2006-229272

(51) Int. Cl.
*G05F 1/00* (2006.01)

(52) U.S. Cl. ..... 315/291; 315/247; 315/307; 315/312; 315/224

(58) Field of Classification Search ..... 315/247, 315/224, 225, 209 R, 185 S, 291, 297, 307–311, 315/312

See application file for complete search history.

(56) References Cited

U.S. PATENT DOCUMENTS

2007/0210727 A1 9/2007 Sun et al.
2008/0030143 A1 2/2008 Goriki et al.

(Continued)

FOREIGN PATENT DOCUMENTS

JP 2871891 1/1999
JP 2001-210490 8/2001
JP 2003-338391 11/2003
JP 2005-19137 1/2005

OTHER PUBLICATIONS

Japanese Official Action that issued with respect to Japanese Patent Application No. 2006-229272, mailed Oct. 19, 2010 (along with a partial English language translation thereof).

(Continued)

*Primary Examiner* — Tuyet Thi Vo

(74) *Attorney, Agent, or Firm* — Greenblum & Bernstein, P.L.C.

(57) ABSTRACT

In order to optimally control power outputted from a high intensity discharge lamp lighting device for a difference among loads connected thereto, such as a difference in gas components contained in arc tubes and a difference in shape of the arc tubes individually in a plurality of discharge lamps 11, plural kinds of output power characteristics W1, W2 and W3 as data tables of lamp voltage-lamp power are provided for a rating lamp voltage range of each of the high intensity discharge lamps 1 and a lamp voltage range lower than the rating lamp voltage range, there is provided minimum lamp voltage detecting means 7 for allowing predetermined power to be outputted in an event of starting the high intensity discharge lamp 11, and detecting a minimum lamp voltage Vmin after the high intensity discharge lamp shifts to an arc discharge, and in response to that the detected minimum lamp voltage Vmin enters any range of a plurality of preset voltage ranges A, B and C, any of the data tables W1, W2 and W3 of the lamp voltage-lamp power, which correspond to the voltage ranges A, B and C, respectively, is selected.

8 Claims, 5 Drawing Sheets

U.S. PATENT DOCUMENTS

| | | | |
|---|---|---|---|
| 2008/0048586 | A1 | 2/2008 | Hasegawa et al. |
| 2008/0143270 | A1 | 6/2008 | Sun et al. |
| 2008/0157693 | A1 | 7/2008 | Yamamoto et al. |

OTHER PUBLICATIONS

Canadian Official Action that issued with respect to Canadian Patent Application No. 2,661,625, mailed Sep. 23, 2010.

English language Abstract of JP 2001-210490, Aug. 3, 2001.

English language Abstract of JP 2003-338391, Nov. 28, 2003.

English language Abstract of JP 4-342988, Nov. 30, 1992.

English language Abstract of JP 2005-19137, Jan. 20, 2005.

U.S. Appl. No. 12/438,582 to Fukuda et al., which was filed on Feb. 24, 2009.

U.S. Appl. No. 12/439,083 to Onishi et al., which was filed on Feb. 26, 2009.

(a)

(b)

(c)

HIGH INTENSITY DISCHARGE LAMP LIGHTING DEVICE AND LIGHTING FIXTURE

TECHNICAL FIELD

The present invention relates to a high intensity discharge lamp lighting device that lights a high brightness/high intensity discharge lamp (HID lamp) such as a high intensity mercury lamp and a metal halide lamp, and to a lighting fixture using the high intensity discharge lamp lighting device.

BACKGROUND ART

As a conventional technology, for example, it is proposed in Japanese Patent Publication No. 2871891 that a ballast stores or estimates a lamp voltage when a lamp is lighted at rating, and in response to a value of the stored or estimated lamp voltage, controls lamp power at the time when the lamp is actuated next time. However, in this document, mainly described are power control for one and the same lamp, which corresponds to aging thereof, and control for the power when the lamp is in a restarting state (hot restart), and accordingly, in accordance with this technology, it has been impossible to control the power in order to drive lamps different in rating power.

In Japanese Patent Laid-Open Publication No. 2005-19137, it is described that a data table describing output power characteristics of lamp voltage-lamp power of a high intensity discharge lamp is provided, constant power control is performed in a range where the lamp voltage is from a rating lamp voltage V1 to a lamp voltage V2 (>V1) in the end of a lifetime of the lamp, and when the lamp voltage exceeds V2, control is performed so as to increase a lamp current more than in the constant power control. A technology described in this document aims to ensure necessary illuminance even at the time of driving the lamp in which the lifetime nearly reaches the end. Accordingly, in accordance with this technology, it has been impossible to perform power control corresponding to a difference in characteristics among lamps, each of which is at the beginning of a lifetime thereof.

The present invention has been made in consideration for such points as described above. It is an object of the present invention to optimally control power outputted from a high intensity discharge lamp lighting device to loads connected thereto in response to characteristics different for each of discharge lamps while coping with a difference among the loads, such as a difference in gas components contained in arc tubes, and a difference in shape of the arc tubes.

DISCLOSURE OF THE INVENTION

In order to solve the above-described problems, a high intensity discharge lamp lighting device according to the present invention includes: storage means in which a plurality of output power characteristics as data tables of lamp voltage-lamp power are stored for a rating lamp voltage range of a high intensity discharge lamp and a lamp voltage range lower than the rating lamp voltage range; minimum lamp voltage detecting means for allowing predetermined power to be outputted in an event of starting the high intensity discharge lamp, and detecting a minimum lamp voltage after the high intensity discharge lamp shifts to an arc discharge or a value equivalent to the minimum lamp voltage during a predetermined period including the minimum lamp voltage; selection means for determining which voltage range among a plurality of preset voltage ranges the minimum lamp voltage detected by the minimum lamp voltage detecting means or the value equivalent to the minimum lamp voltage, the value being detected thereby, enters, and for selecting the data table corresponding to the voltage range; and control means for controlling power supplied to the high intensity discharge lamp with reference to the data table selected by the selection means.

BEST MODE FOR CARRYING OUT THE INVENTION

Embodiment 1

Figure 1:
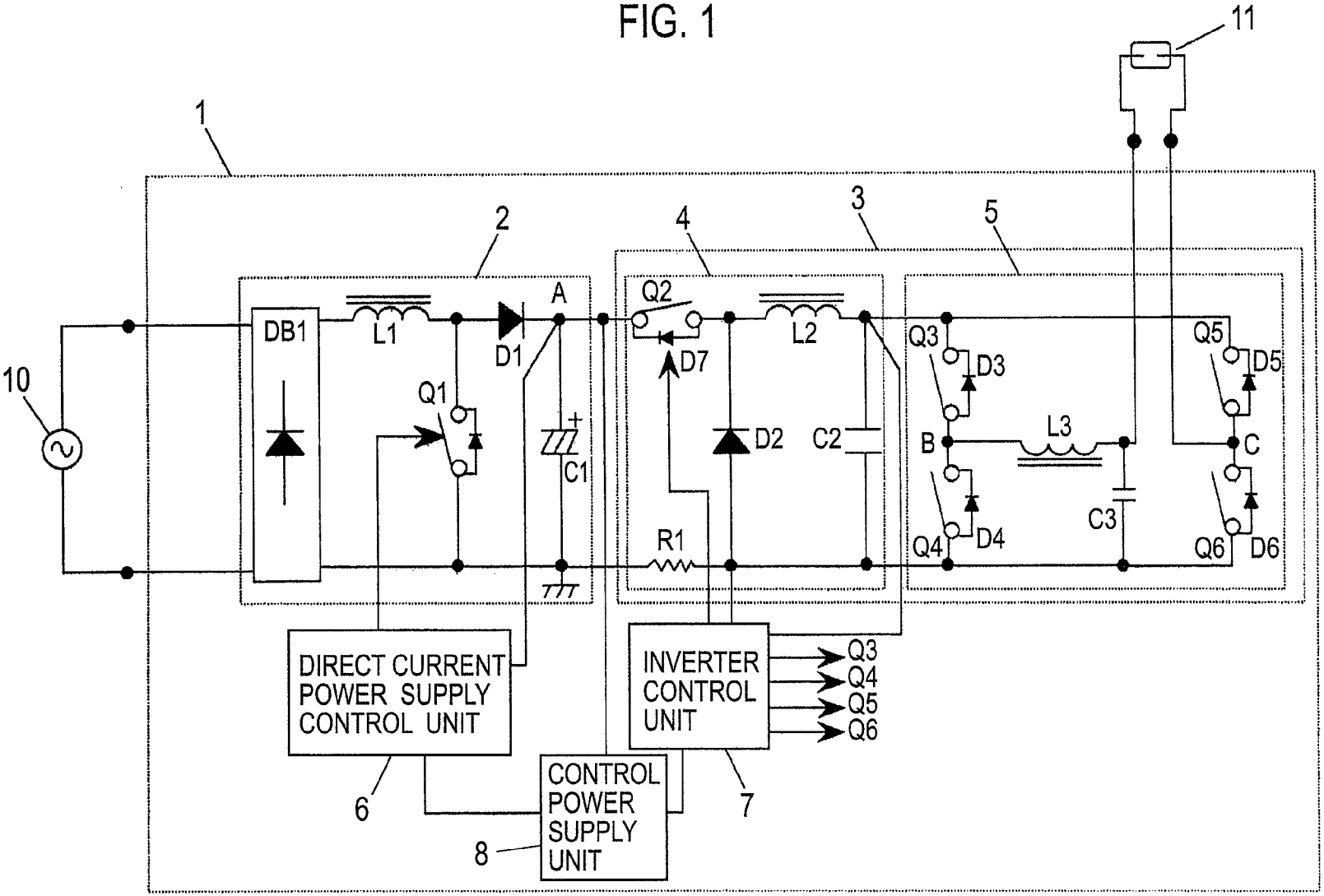
FIG. 1 is a circuit diagram of Embodiment 1 of the present invention.

FIG. 1 shows a circuit diagram of a high intensity discharge lamp lighting device 1 according to Embodiment 1 of the present invention. This high intensity discharge lamp lighting device 1 is also called a ballast used for obtaining a stable discharge. This high intensity discharge lamp lighting device 1 is composed of a direct current power supply circuit unit 2, and an inverter circuit unit 3. The inverter circuit unit 3 is composed of a step-down chopper circuit 4, and a polarity inversion circuit 5. Moreover, the high intensity discharge lamp lighting device 1 includes a direct current power supply control unit 6 that controls operations of the direct current power supply circuit unit 2, and an inverter control unit 7 that controls operations of the inverter circuit unit 3, and includes a control power supply unit 8 that supplies power supply voltages to the individual control units 6 and 7.

The direct current power supply circuit unit 2 is composed of a rectifier DB1 that performs full-wave rectification for an alternating current power supply 10, and of a step-up chopper circuit composed of an inductor L1, a switching element Q1, a diode D1 and a capacitor C1. The direct current power supply circuit unit 2 converts an alternating current input from the commercial alternating current power supply 10 into a direct current output, and supplies the direct current output to the inverter circuit unit 3. The direct current power supply control unit 6 controls ON/OFF of the switching element Q1 so that a direct current voltage of the capacitor C1, which is obtained at a point A, can become a predetermined value. As this direct current power supply control unit 6, a commercially available integrated circuit for improving and controlling a power factor, and the like can be used.

The step-down chopper circuit 4 is composed of a switching element Q2, a diode D2, an inductor L2 and a capacitor C2, and outputs a direct current voltage obtained by dropping such an input voltage from the direct current power supply circuit unit 2. The step-down chopper circuit 4 is used as a stabilizing element that adjusts supply power to a discharge lamp (lamp) 11 by controlling ON/OFF of the switching element Q2. Here, since operations of the step-down chopper circuit 4 belong to the general technology, a description thereof will be omitted. Note that a diode D7 is an anti-parallel diode to the switching element Q2.

The polarity inversion circuit 5 supplies a square wave alternating current power to the discharge lamp 11 in such a manner that a pair of switching elements Q3 and Q6 and a pair of switching elements Q4 and Q5 are alternately switched ON/OFF at a low frequency of several ten to several hundred Hertz by control signals from the inverter control unit 7. However, at the time of starting the discharge lamp 11, the switching elements Q3 and Q4 are alternately switched ON/OFF at a high frequency, a high voltage raised by a resonance function of an inductor L3 and a capacitor C3 is applied to the discharge lamp 11, and an electrical breakdown is caused therein. Note that diodes D3 to D6 are anti-parallel diodes to the respective switching elements Q3 to Q6.

The inverter control unit 7 detects a lamp voltage V1*a* of the discharge lamp 11 by a voltage of the capacitor C2, and moreover, detects a lamp current by detecting a chopper current by means of a resistor R1, and controls the switching element Q2 so as to obtain lamp power W1*a* corresponding to the lamp voltage V1*a* (control means).

Moreover, the inverter control unit 7 gives the control signals to the switching elements Q3 to Q6, and controls polarity inversion operations.

After the discharge lamp 11 is started, an output terminal voltage of the step-down chopper circuit 4 becomes substantially equal to the lamp voltage V1*a* of the discharge lap 11, and a value of a divided voltage of the output voltage concerned is read in by the inverter control unit 7. In response to the read lamp voltage V1*a* or a value equivalent to the lamp voltage V1*a*, the inverter control unit 7 decides the lamp power W1*a* supplied to the discharge lamp 11, then controls the switching element Q2 to be switched ON/OFF, and thereby generates the desired lamp power W1*a*. The inverter control unit 7 stores data tables (hereinafter, referred to as "power curves") of the lamp power W1*a* supplied to the discharge lamp 11 in response to the lamp voltage V1*a* detected at the time of starting the discharge lamp 11 (storage means). The lamp power W1*a* is decided in such a manner that the inverter control unit 7 concerned refers to the power curves based on the lamp voltage V1*a*.

Figure 2:
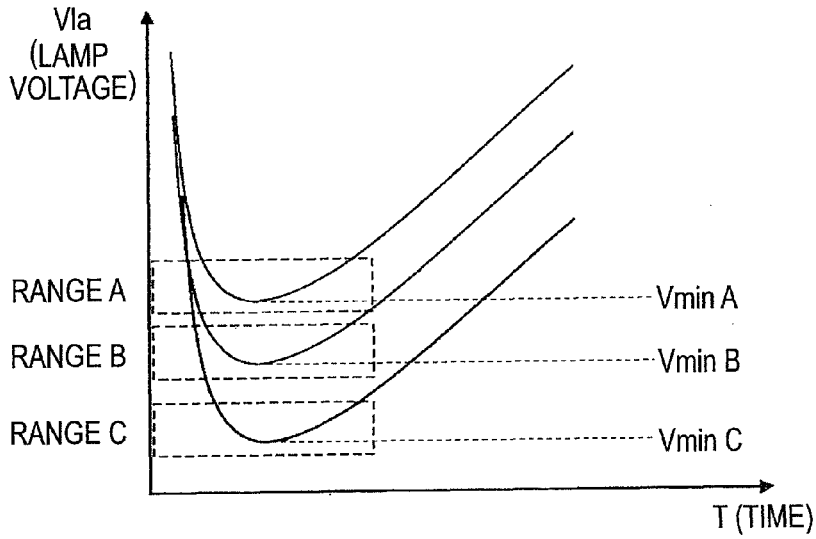
FIG. 2 is an operation explanatory diagram according to a first embodiment to which the present invention is applied.

This high intensity discharge lamp lighting device 1 is provided with a function to detect a lamp voltage V1*a* during a predetermined period including, as shown in FIG. 2, a minimum lamp voltage Vmin after the discharge lamp 11 is started and shifts to an arc discharge or a minimum lamp voltage Vmin as a value equivalent to that in this case. This function is provided in the inverter control unit 7. The inverter control unit 7 provides at least two or more voltage ranges A, B and C for the lamp voltage V1*a* at the time when the minimum lamp voltage Vmin is detected so that the detected minimum lamp voltage Vmin can be coped with.

Figure 4:
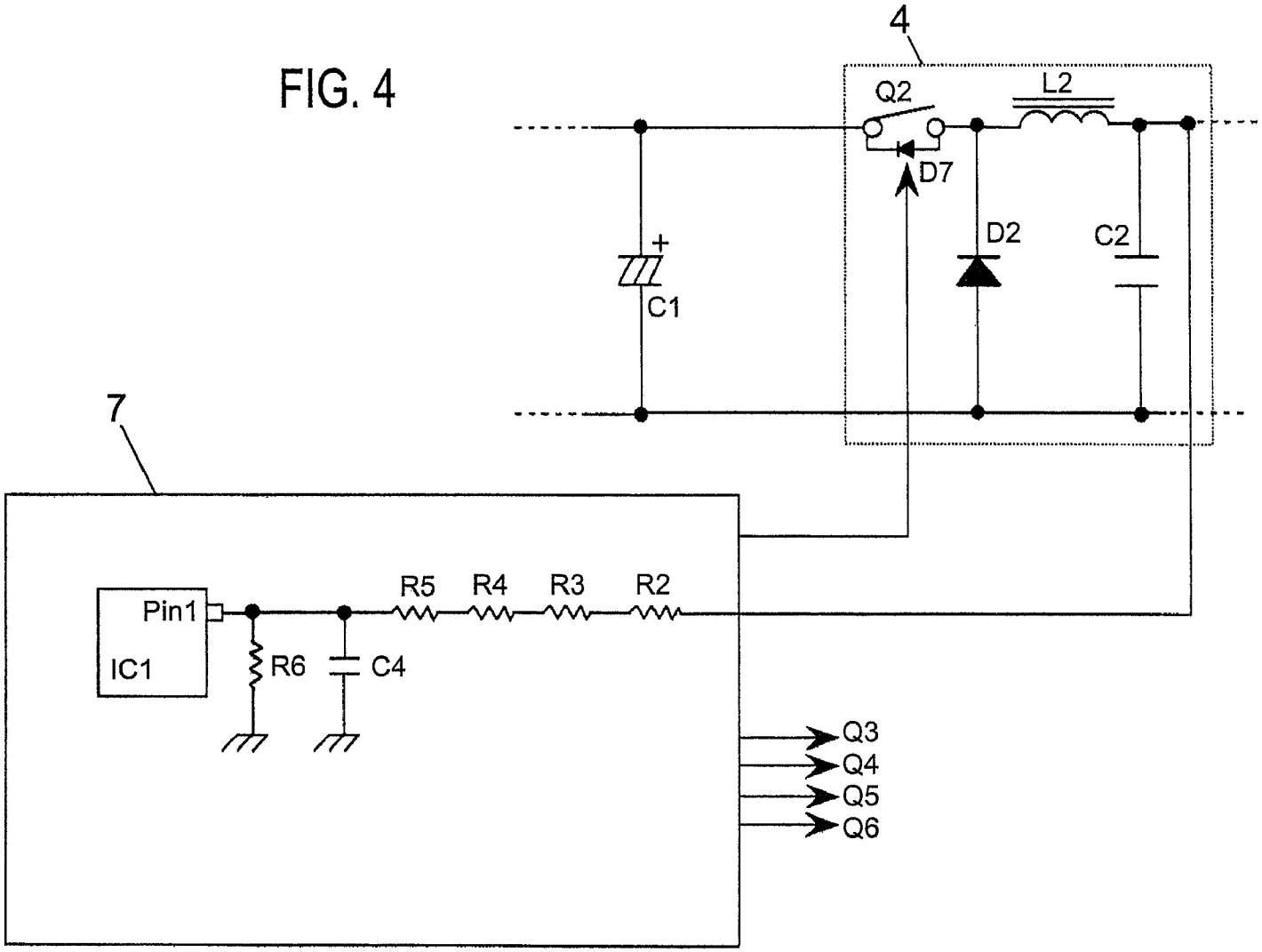
FIG. 4 is a circuit diagram showing a configuration of a minimum lamp voltage detection circuit for use in Embodiment 1 of the present invention.

Immediately after starting the discharge lamp 11, the high intensity discharge lamp lighting device 1 supplies a lamp current I1*a* corresponding to the lamp voltage V1*a* along an initially set power curve. Here, the high intensity discharge lamp lighting device 1 reads in the equivalent value to the minimum lamp voltage Vmin after the discharge lamp 11 is started. Specifically, as shown in FIG. 4, the output voltage of the step-down chopper circuit 4 after the lamp is started is divided/smoothed by resistors R2 to R6 and a capacitor C4, and the divided/smoothed output voltage is read in by a minimum lamp voltage detector IC1 mounted in the inverter control unit 7. The lamp voltage V1*a* after the discharge lamp 11 is started shows a transition as shown in FIG. 2, and the IC1 captures and reads the minimum lamp voltage Vmin therein from the voltage transition concerned. In such a way, the inverter control unit 7 detects the minimum lamp voltage Vmin after the discharge lamp 11 is started and shifts to the arc discharge.

The inverter control unit 7 compares a value of the detected minimum lamp voltage Vmin with reference voltages (voltage ranges A, B, C) in an inside of the inverter control unit 7, and selects the power curve in response to a result of such comparison.

Figure 3:
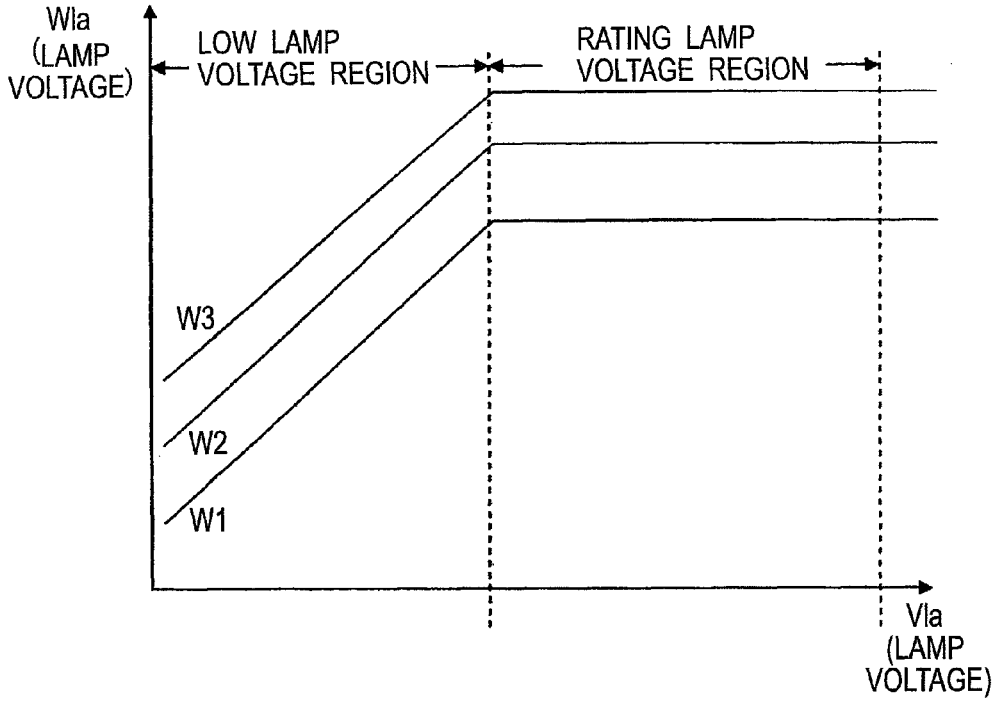
FIG. 3 is a characteristic chart showing output characteristics of Embodiment 1 of the present invention.

FIG. 3 shows the "power curves" mounted in the high intensity discharge lamp lighting device 1 of the present invention. These power curves are data tables, each of which includes a relationship between the lamp voltage V1*a* and the lamp power W1*a* in a rating lamp voltage range (region) of the discharge lamp 11, and a relationship between the lamp voltage V1*a* and the lamp power W1*a* in a lamp voltage range (region) lower than the rating lamp voltage range concerned. A plurality of the power curves, such as W1, W2 and W3, are created, and are stored in the inverter control circuit unit 7. Here, a feature of the present invention is in that the plurality of "power curves" are provided, and the inverter control unit 7 has the data tables W1, W2 and W3 of the lamp voltage-lamp power, of which number is equal to or smaller than the number of voltage ranges A, B and C of the minimum lamp voltage Vmin, which are shown in FIG. 2.

For example, in the case where a minimum lamp voltage VminA staying within the voltage range A of FIG. 2 is detected, the inverter control unit 7 resets the power curve W1 of FIG. 3, as subsequent output characteristics. Moreover, in the case where a minimum lamp voltage VminB staying within the voltage range B of FIG. 2 is detected, the inverter control unit 7 resets the power curve W2 of FIG. 3, as subsequent output characteristics. Furthermore, in the case where a minimum lamp voltage VminC staying within the voltage range C of FIG. 2 is detected, the inverter control unit 7 resets the power curve W3 of FIG. 3, as subsequent output characteristics. In such a way, the inverter control unit 7 functions as selection means for selecting the data table based on the minimum lamp voltage Vmin detected at the time of starting the discharge lamp 11, and functions as control means for controlling the power supplied to the discharge lamp 11 based on the data table concerned. Note that the output characteristics initially set immediately after the discharge lamp 11 is started may be any of W1, W2 and W3, or output characteristics for determining the minimum lamp voltage Vmin may be set separately.

In the case where the discharge lamp 11 is a high intensity discharge lamp, there are somewhat correlations between the value of the detected minimum lamp voltage Vmin and components of gas filled therein, a difference in shape of arc tubes, and the like. Hence, if voltage ranges to an extent of considering manufacturing variations of the same discharge lamps 11 are set in advance for the detected minimum lamp voltage Vmin, then it is possible to identify a type (difference in arc tube structure, color temperature and wattage, and the like) of the discharge lamp 11 based on the detected value of the minimum lamp voltage Vmin at the time of starting the discharge lamp 11.

From the above, in accordance with the high intensity discharge lamp lighting device 1 according to the above-described Embodiment 1, the output characteristics of the lamp voltage V1*a* and the lamp power W1*a*, which are optimum for characteristics of each of the inserted discharge lamps 11, can be set. In such a way, the lamp power W1*a* during a period from when the discharge lamp 11 is started to when the discharge lamp 11 reaches stable lighting can be controlled to the optimum value. In addition, after the discharge lamp 11 shifts to the stable lighting, the lamp power W1*a* supplied to the discharge lamp 11 can be controlled to the optimum value.

Embodiment 2

Next, a description will be made of a high intensity discharge lamp lighting device according to Embodiment 2 of the present invention.

As sizes of the ranges of the minimum lamp voltage Vmin detected as described above are varied, the high intensity discharge lamp lighting device 1 according to Embodiment 2 also sequentially assigns the data tables W1, W2 and W3 selected by the inverter control unit 7 in accordance with sizes thereof in the high intensity discharge lamp lighting device 1 of the above-described Embodiment 1.

Specifically, if the detected minimum lamp voltage Vmin enters the highest voltage range A among the plurality of voltage ranges of the minimum lamp voltage Vmin, then, as the data table of the lamp power-lamp voltage, which corresponds to the voltage range A, the high intensity discharge lamp lighting device 1 also selects the data table W3 in which a rating power value is the highest, and controls the output to the discharge lamp 11. Moreover, if the detected minimum lamp voltage Vmin enters the intermediate voltage range B, then, as the data table of the lamp power-lamp voltage, which corresponds to the voltage range B, the high intensity discharge lamp lighting device 1 also selects the data table W2 in which a rating power value is intermediate, and controls the output to the discharge lamp 11. Furthermore, if the detected minimum lamp voltage Vmin enters the lowest voltage range C, then, as the data table of the lamp power-lamp voltage, which corresponds to the voltage range C, the high intensity discharge lamp lighting device 1 also selects the data table W1 in which a rating power value is the lowest, and controls the output to the discharge lamp 11.

For example, in the case of the discharge lamps 11 in which the gas components contained in the arc tubes and the sizes of the arc tubes are the same and the wattages differ from one another, the minimum lamp voltage Vmin becomes larger in order from the discharge lamp 11 in which the wattage is larger. This feature of the discharge lamps 11 is used, and as the sizes of the ranges of the detected minimum lamp voltage Vmin are varied, the high intensity discharge lamp lighting device 1 also sequentially assigns the data tables W1, W2 and W3 referred to in the event of controlling the discharge lamps 11 in accordance with the sizes thereof. In such a way, in comparison with the high intensity discharge lamp lighting device 1 of Embodiment 1, in the high intensity discharge lamp lighting device 1 according to Embodiment 2, it becomes possible to simplify a control circuit composing the inverter control unit 7.

Embodiment 3

Next, a description will be made of a high intensity discharge lamp lighting device 1 according to Embodiment 3 of the present invention.

In the above-described high intensity discharge lamp lighting device 1, at the time of setting in advance the voltage ranges of the minimum lamp voltage Vmin in order to detect the discharge lamps 11 different in wattage, it is considered that the voltage ranges which can be taken by the minimum lamp voltage Vmin overlap each other or one another owing to approximations of magnitudes of the manufacturing variations and of magnitudes of the wattages, and the like. In an example of FIG. 5, the voltage range A and the voltage range B partially overlap each other, and moreover, the voltage range B and the voltage range C partially overlap each other.

If the value of the minimum lamp voltage Vmin of a portion where the voltage ranges A, B and C overlap one another is detected, then an inverter control unit 7 of the high intensity discharge lamp lighting device 1 according to Embodiment 3 performs processing for detecting an inclination of rising of the lamp voltage V1*a* with elapse of time (lamp voltage inclination detecting means), and reselecting the data table of the lamp voltage-lamp power based on the inclination of the lamp voltage V1*a* at the time of the rising thereof, as well as the processing for selecting the data table based on the voltage range to which the minimum lamp voltage Vmin applies, which is shown in Embodiment 1 or Embodiment 2.

In general, the discharge lamp 11 in which the rating lamp power is low has a small arc tube shape, and accordingly, the rising of the lamp voltage V1*a* is steep. For example, in the case of the discharge lamp 11 that exhibits a behavior in which the inclination of the rising of the lamp voltage V1*a* by the elapse of time is steep, the data table in which the rating lamp power is low is selected and set among the data tables stored in the inverter control unit 7. In such a way, discrimination accuracy for the difference in shape of the discharge lamps 11 can be enhanced.

Figure 5:
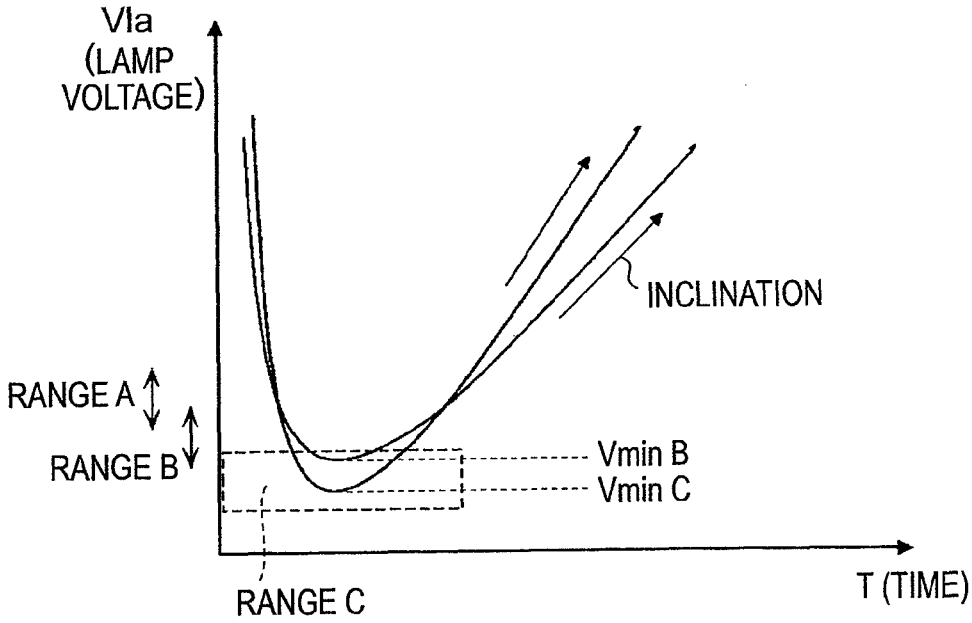
FIG. 5 is an operation explanatory diagram of Embodiment 3 of the present invention.

In the example of FIG. 5, in the case where the minimum lamp voltage VminB that enters both of the voltage range B and the voltage range C is detected, the inverter control unit 7 determines that the rating lamp voltage is large since the inclination of the rising of the lamp voltage V1*a* is gentle, and selects the data table corresponding to the voltage range B. In the case where the minimum lamp voltage VminC that enters only the voltage range C is detected, the inverter control unit 7 selects the data table corresponding to the voltage range C.

As described above, in accordance with the high intensity discharge lamp lighting device 1 according to Embodiment 3, in the case where the voltage ranges which can be taken by the minimum lamp voltage Vmin overlap each other or one another owing to the manufacturing variations and the like of the discharge lamps 11, any of the voltage ranges is selected based on the inclination of the lamp voltage V1*a*, whereby the data table corresponding to the voltage range concerned can be selected.

Embodiment 4

Next, a description will be made of a high intensity discharge lamp lighting device 1 according to Embodiment 4 of the present invention.

Figure 6:
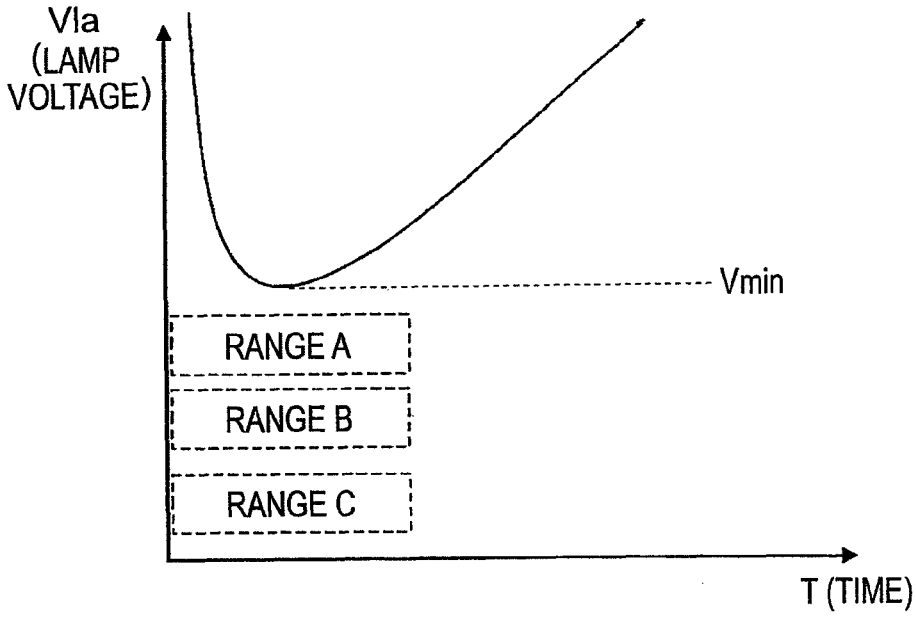
FIG. 6 is an operation explanatory diagram of Embodiment 4 of the present invention.

In the high intensity discharge lamp lighting devices 1 of the above-described Embodiments 1 to 3, the high intensity discharge lamp lighting device 1 according to Embodiment 4 of the present invention detects the minimum lamp voltage Vmin, and stops the output to the discharge lamp 11 in the case where the minimum lamp voltage Vmin concerned does not apply to any of the plurality of voltage ranges A, B and C provided for the lamp voltage V1*a* as shown in FIG. 6. Specifically, the inverter control unit 7 stops the operations of the step-down chopper circuit 4 and polarity inversion circuit 5 of the inverter circuit unit 3.

In accordance with the high intensity discharge lamp lighting device 1 according to this embodiment, in the case where a load (that is, a discharge lamp 11 that is different in wattage, is in an abnormal state, and so on) other than the discharge lamp 11 determined to be adaptable is connected thereto, the output to the discharge lamp 11 is stopped, and a risk of breakage or the like of the discharge lamp 11 is prevented from occurring.

Embodiment 5

Next, a description will be made of Embodiment 5 of the present invention. Embodiment 5 is one using, for a lighting fixture, the high intensity discharge lamp lighting device 1 of any of the above-described Embodiments 1 to 4.

Figure 7:
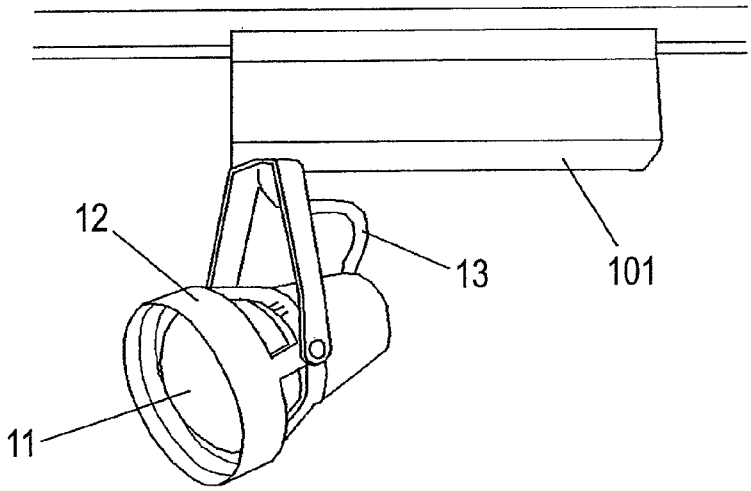
FIG. 7 is perspective views showing exterior appearances of lighting fixtures of Embodiment 5 of the present invention.
Figure 7:
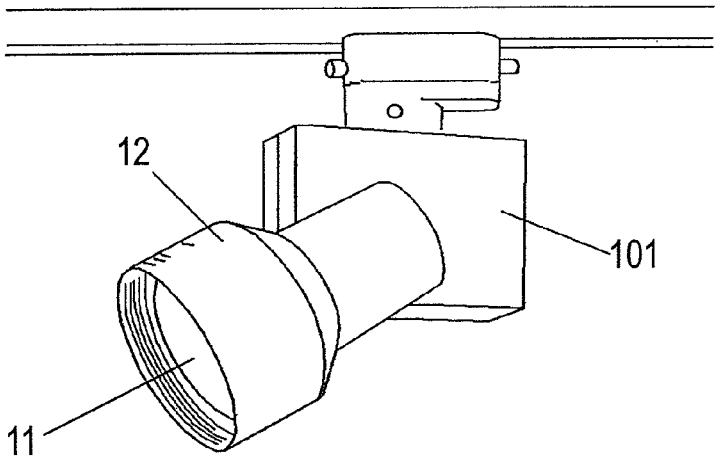
Figure 7:
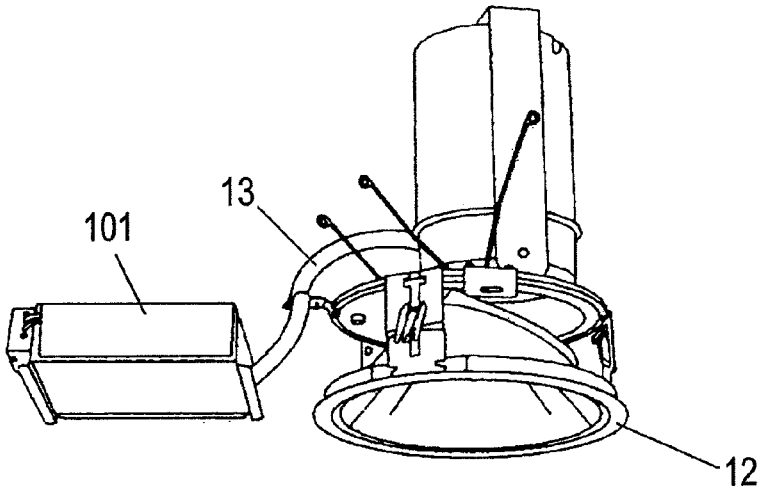

FIGS. 7A to 7C show configuration examples of the lighting fixture using the high intensity discharge lamp lighting device 1 of the present invention. FIGS. 7A and 7B are examples of individually using the HID lamp for a spotlight, and FIG. 7C is an example of using the HID lamp for a downlight. In each of these drawings, reference numeral 101 denotes a cabinet that houses the above-described high intensity discharge lamp lighting device 1 (ballast), reference numeral 11 denotes the high intensity discharge lamp, reference numeral 12 denotes a lamp body that attaches the high intensity discharge lamp 11 thereinto, and reference numeral 13 denotes a wire. A plurality of these lighting fixtures may be combined to thereby construct an illumination system.

INDUSTRIAL APPLICABILITY

In accordance with the present invention, such a phenomenon is used, that the minimum lamp voltage after the high intensity discharge lamp shifts to the arc discharge differs depending on the difference in gas components contained in the arc tube of the high intensity discharge lamp concerned, the difference in shape of the arc tube, and the like, whereby the output power characteristics can be selected in response to which range among the plurality of preset voltage ranges the detected value of the minimum lamp voltage enters, and the output power characteristics can be optimally controlled in response to the characteristics different for each of the discharge lamps.

The invention claimed is:

1. A high intensity discharge lamp lighting device, comprising:

storage means in which a plurality of output power characteristics as data tables of lamp voltage-lamp power are stored for a rating lamp voltage range of a high intensity discharge lamp and a lamp voltage range lower than the rating lamp voltage range;

minimum lamp voltage detecting means for allowing predetermined power to be outputted in an event of starting the high intensity discharge lamp, and detecting a minimum lamp voltage after the high intensity discharge lamp shifts to an arc discharge or a value equivalent to the minimum lamp voltage during a predetermined period including the minimum lamp voltage;

selection means for determining which voltage range among a plurality of preset voltage ranges the minimum lamp voltage detected by the minimum lamp voltage detecting means or the value equivalent to the minimum lamp voltage, the value being detected thereby, enters, and for selecting the data table corresponding to the voltage range; and control means for controlling power supplied to the high intensity discharge lamp with reference to the data table selected by the selection means.

2. A lighting fixture, comprising: the high intensity discharge lamp lighting device according to claim 1.

3. The high intensity discharge lamp lighting device according to claim 1, wherein the selection means selects a data table in which a rating power output is higher as the minimum lamp voltage detected by the minimum lamp voltage detecting means or the value equivalent to the minimum lamp voltage, the value being detected thereby, enters a higher range among the plurality of preset voltage ranges.

4. A lighting fixture, comprising: the high intensity discharge lamp lighting device according to claim 3.

5. The high intensity discharge lamp lighting device according to claim 1, further comprising:

lamp voltage inclination detecting means for detecting an inclination of the lamp voltage, the inclination being caused by elapse of time, wherein the selection means reselects the data table selected based on the minimum lamp voltage detected by the minimum lamp voltage detecting means to a data table that is based on the inclination of the lamp voltage, the inclination being caused by the elapse of time and detected by the lamp voltage inclination detecting means.

6. A lighting fixture, comprising: the high intensity discharge lamp lighting device according to claim 5.

7. The high intensity discharge lamp lighting device according to claim 1, wherein the output of the power to the high intensity discharge lamp is stopped in a case where the minimum lamp voltage detected by the minimum lamp voltage detecting means or the value equivalent to the minimum lamp voltage, the value being detected thereby, does not enter any range of the plurality of preset voltage ranges.

8. A lighting fixture, comprising: the high intensity discharge lamp lighting device according to claim 7.

* * * * *